US006823910B1

(12) United States Patent
Elnekaveh

(10) Patent No.: US 6,823,910 B1
(45) Date of Patent: Nov. 30, 2004

(54) MONEY CLIP AND CARD HOLDER

(76) Inventor: Alex Elnekaveh, 16713 Roscoe Blvd., No. Hills, CA (US) 91343

( * ) Notice: Subject to any disclaimer, the term of this patent is extended or adjusted under 35 U.S.C. 154(b) by 193 days.

(21) Appl. No.: 10/172,321

(22) Filed: Jun. 14, 2002

Related U.S. Application Data

(60) Provisional application No. 60/298,091, filed on Jun. 15, 2001.

(51) Int. Cl.[7] ..... A45C 11/18

(52) U.S. Cl. ..... 150/147; 224/227

(58) Field of Search ..... 150/147, 137; 224/277, 483; 206/38, 39; 24/563; 40/658, 647

(56) References Cited

U.S. PATENT DOCUMENTS

| | | | | | |
|---|---|---|---|---|---|
| 2,824,591 | A | * | 2/1958 | Anderson | 150/137 |
| D312,415 | S | * | 11/1990 | Muller et al. | D10/31 |
| D313,758 | S | * | 1/1991 | Klose | D10/31 |
| D325,876 | S | * | 5/1992 | Klepper | D10/31 |
| 5,520,230 | A | * | 5/1996 | Sumner, III | 150/147 |
| 5,592,767 | A | * | 1/1997 | Treske | 40/649 |
| D400,466 | S | * | 11/1998 | Gleason | D11/781 |
| 5,944,080 | A | * | 8/1999 | Podwika | 150/147 |
| D426,703 | S | * | 6/2000 | Kojoori | D3/249 |
| 6,082,422 | A | * | 7/2000 | Kaminski | 150/147 |

* cited by examiner

*Primary Examiner*—Stephen K. Cronin
*Assistant Examiner*—Lien Ngo
(74) *Attorney, Agent, or Firm*—Roger A. Marrs

(57) ABSTRACT

A combined money clip, watch case, and card holder having a flat plate with a pivotal money clip on one side and a card holding receptacle on the other side. The money clip includes an outwardly projecting mount defining an inner space which is partially occupied by a hinge member supporting a watch and which includes a helical spring and having opposite ends which bear against one side of the plate and the other side pivotally carried on the mount. A latch member is carried on the hinge and is spring-biased into a closed position with its free end bearing against the plate when on one side of a spring toggle line and wherein the latch member is loose when positioned on the other side of the spring-toggle line. A receptacle is defined by a pair of lobes which extend from plate side members towards one another in spaced-apart opposition.

2 Claims, 4 Drawing Sheets

FIG. 1
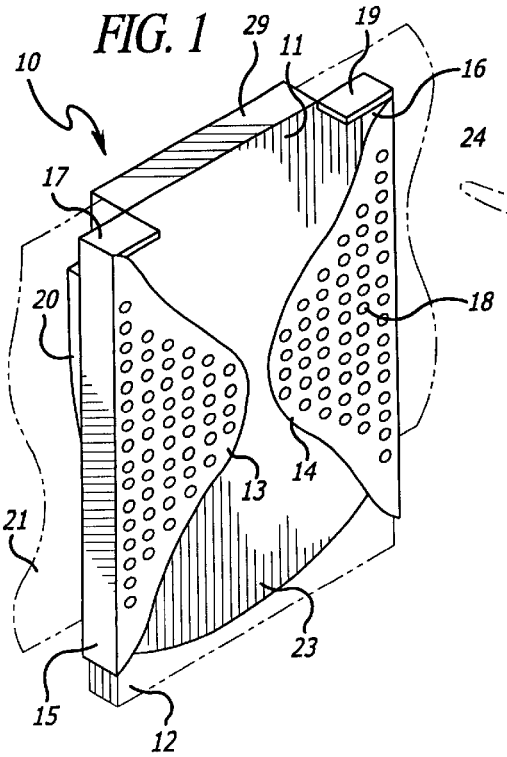
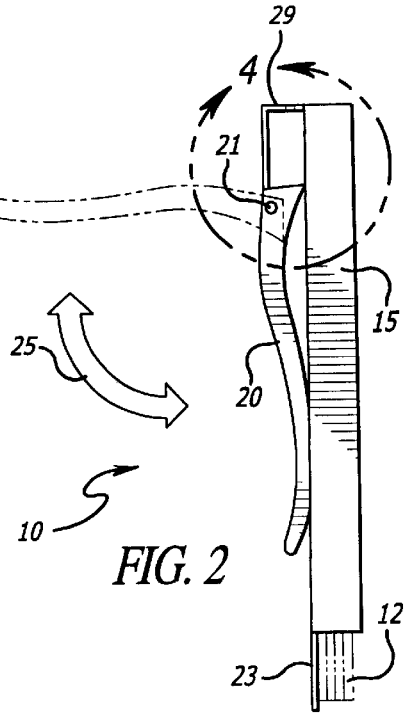
FIG. 2
FIG. 3
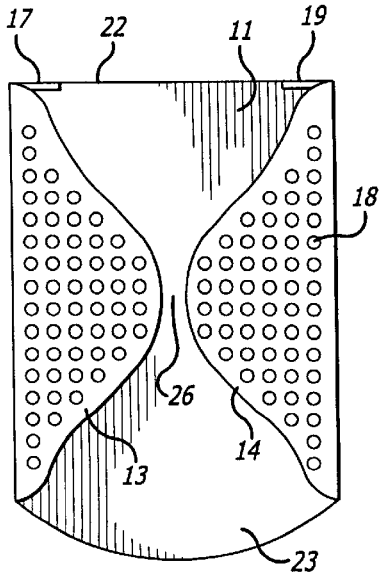
FIG. 4
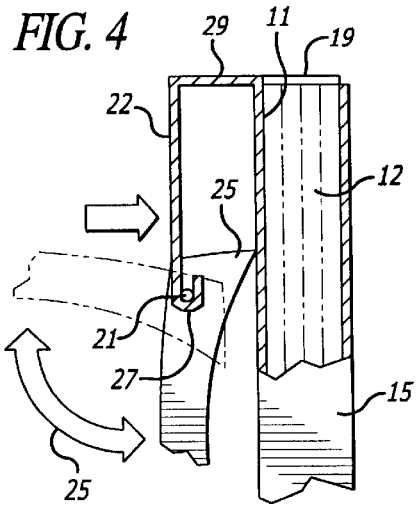

FIG. 6
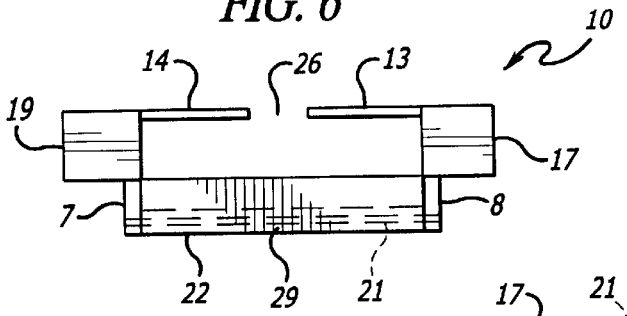
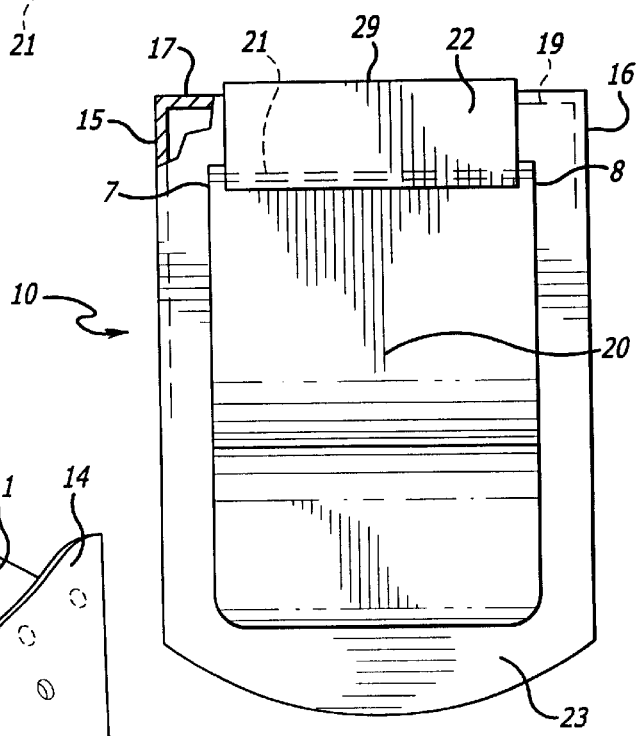
FIG. 5
FIG. 7
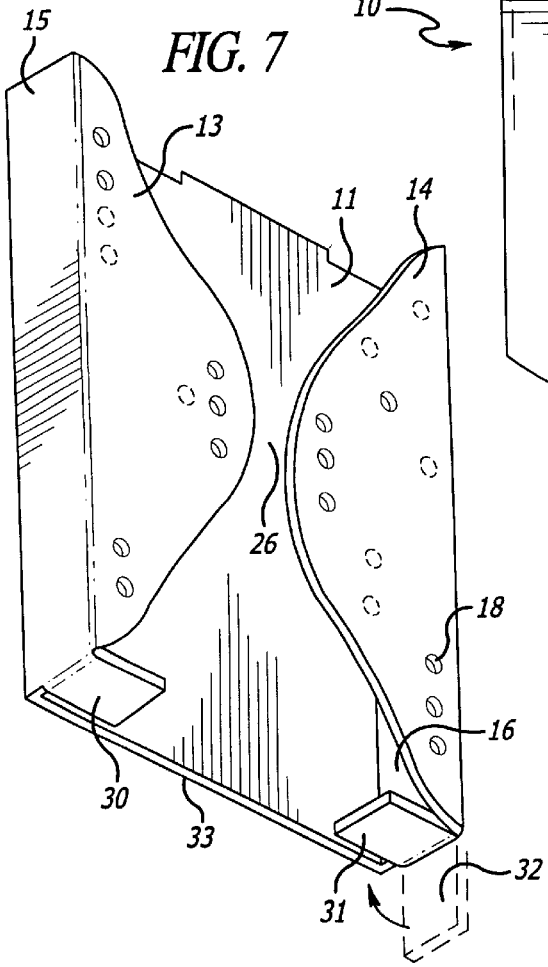

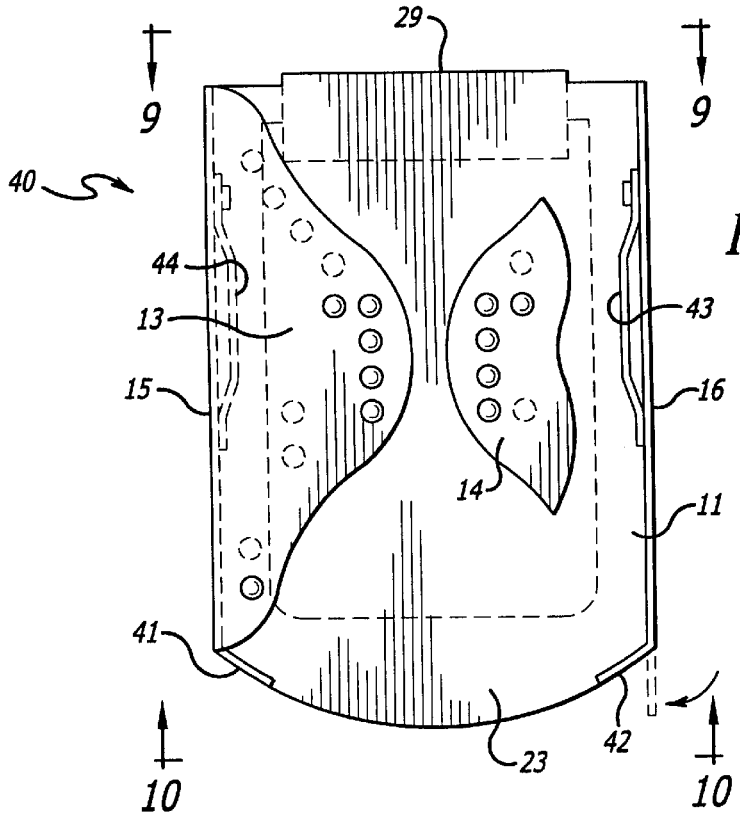
FIG. 8
FIG. 9
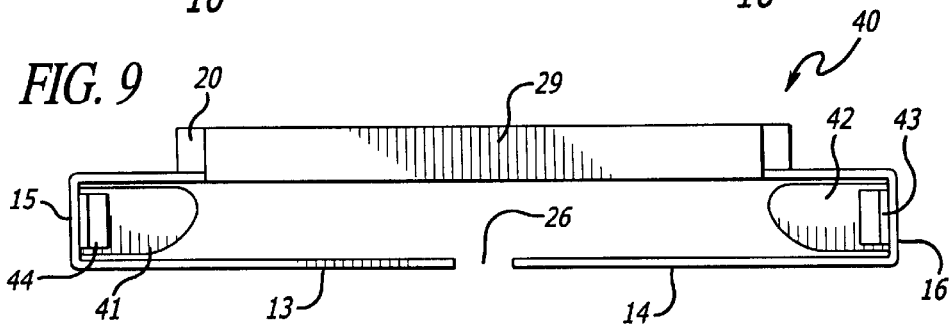
FIG. 10
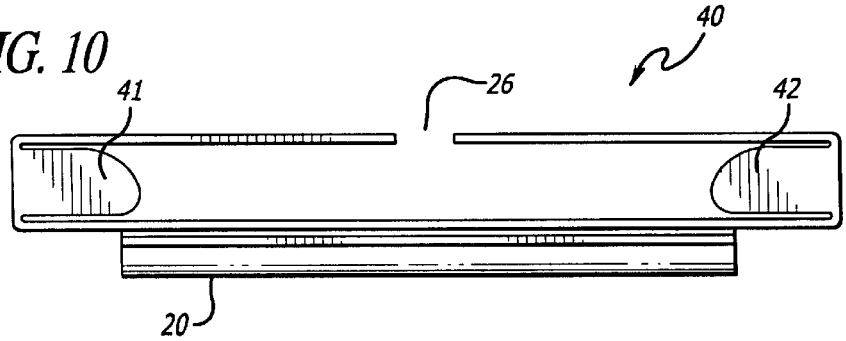

MONEY CLIP AND CARD HOLDER

Priority Claimed based on Ser. No. 60/298,091 filed Jun. 15, 2001.

BACKGROUND OF THE INVENTION

1. Field of the Invention

The present invention relates to the field of money clips and card holders, and more particularly to a novel combined money clip and card holder having dynamic and positive clamping means for holding a quantity of folded money and having a card receptacle for holding a quantity of cards, with improved frictional engagement between the holder and the cards.

2. Brief Description of the Prior Art

In the past, it has been the conventional practice to employ a holder having a spring clip on one side for retaining a quantity of folded money, such as bills or the like, and on the opposite side a receptacle for holding a quantity of business or credit cards. Such a conventional money clip and holder is disclosed in U. S. Pat. No. 5,358,019. However, problems and difficulties have been encountered with such prior money clip and card holders which stem from the fact that the spring clip has a permanent bias which becomes weakened after use and, therefore, renders the clip unsuitable for holding folded bills. Also, the receptacle for holding the cards relies on a reduced surface area with the cards for personal retention. Thus, as the self-biasing spring clip fatigues, the life of the holder as a means for holding folded cash is limited, while the receptacle for holding cards is ineffective since the frictional retention area is insufficient to retain cards in the receptacle during prolonged use.

Therefore, a long-standing need has existed to provide a combined money clip and card holder which promotes long life and usage for releasably retaining folded money, such as paper bills or the like, and which further includes improved retention means for holding a plurality of cards in a receptacle.

SUMMARY OF THE INVENTION

Accordingly, the above problems and difficulties are avoided by the present invention which provides a novel, combined money clip and card holder having a flat plate with a money clip on one side and a card holding receptacle on the other side. The money clip includes an outwardly projecting mount defining an inner space which is partially occupied by a hinge member which includes a helical spring having opposite ends which bear against one side of the plate and the other side against the mount. A latch member is carried on the hinge and is spring-biased into a closed position with its free end against the plate when on one side of a toggle line and wherein the latch member is loose when positioned on the other side of the spring-toggle line. Therefore, the latch may be completely open when on one side of the spring-toggle line while biased into the closed position on the other side of the spring toggle line. With respect to the receptacle, the receptacle is defined by a pair of lobes which extend from side members towards one another in spaced-apart composition. The receptacle is defined between the sides and the undersurface of the lobes so that a plurality of cards may be slipped against the plate under the lobes for retention. A projection outwardly extends from the plate serving as a stop so that cards introduced into the receptacle can travel a limited distance and can reside in the receptacle against the stop. A feature of the invention resides in providing the lobes with a plurality of apertures so as to remove unnecessary material and, therefore, lighten the overall holder. The lobes are of broad surface area so as to engage or contact a substantial area of the outermost card in the stack which is stored in the receptacle.

Accordingly, it is among the primary objects of the present invention to provide a combined money clip and card holder which is light in weight and which includes a spring-latch on one side of a plate and a card holding receptacle on the opposite side of the plate, wherein the latch is spring-biased between two positions on opposite sides of a spring toggle line.

Another object of the present invention is to provide a novel combined money clip and card holder having an improved receptacle for holding a plurality of cards wherein the retention means presents a frictional surface area for frictionally contacting a substantial area of an uppermost card in the stack.

Still a further object of the present invention is to provide a novel combined money clip and card holder which is not only light in weight but which has improved spring-latching means for holding folded money and which further includes superior frictional holding means for a card holder on the opposite side of a center plate from the spring latch means.

A further object resides in providing a money clip and card holder combination having a pair of stop tabs inwardly projecting from the sides of the card holder to arrest movement of cards from a storage cavity or receptacle.

Another object resides in providing side tabs integrally formed with the sides of a card holder for limiting positioning or insertion of cards into a storage cavity or compartment.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description taken in connection with the accompanying drawings in which:

FIG. 1 is a elevational view illustrating the combined money clip and card holder incorporating the present invention;

FIG. 2 is a side-elevational view of the combined money clip and card holder illustrated in FIG. 1;

FIG. 3 is a rear elevational view of the combined money clip and card holder;

FIG. 4 is an enlarged fragmentary side-elevational view, partly in section, illustrating the hinge and latch arrangement, as well as the storage compartment, employed in the combined money clip and card holder of the present invention;

FIG. 5 is a front elevational view of the money clip side of the combined money clip and card holder;

FIG. 6 is a top plan view of the combined money clip and card holder; and

FIG. 7 is a rear elevational view showing the card-holding side of the combined money clip and card holder.

FIG. 8 is a rear elevational view of another version of the present invention having card stops and resilient card retainers;

FIG. 9 is a top plan view of the combined money clip and card holder version shown in FIG. 8;

FIG. 10 is a bottom view of the combined money clip and card holder version shown in FIGS. 8 and 9 respectively.

DESCRIPTION OF PREFERRED EMBODIMENT

Figure 11:
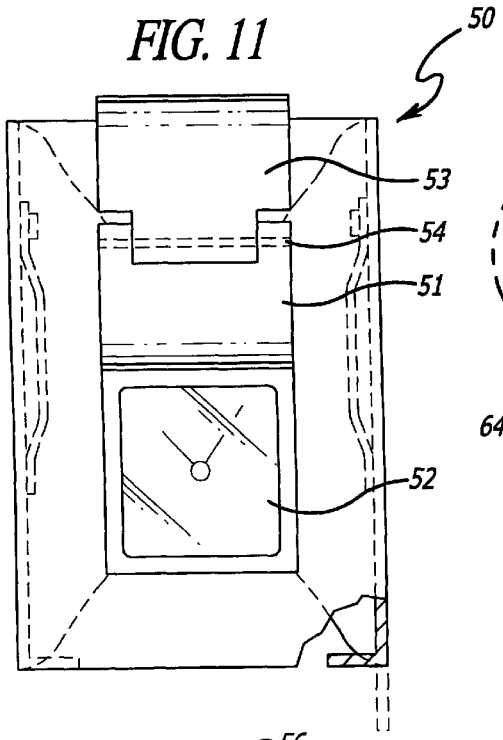
FIG. 11 is a front perspective elevational view, partially broken away, illustrating another embodiment of the present invention including a dial watch.

Referring now to FIG. 1, the novel combined money clip and card holder of the present invention is illustrated in the general direction of arrow 10, which includes an elongated plate of high aspect ratio indicated by numeral 11, which includes a card holding receptacle on one side of the plate and a money clip on the other side of the plate. The receptacle for holding a plurality of cards 12 includes a pair of lobes 13 and 14 which are carried on opposite side members 15 and 16 integrally formed with the opposite side of plate 11. The distance or dimension between the sides 15 and 16 is sufficient to provide for a number of cards 12 to be inserted from an open end of the receptacle beneath the lobes 13 and 14 and to abut against a pair of stop flanges or tabs 17 and 19 projecting into the receptacle from opposite sides 15 and 16. It is to be particularly noted that the lobes 13 and 14 are provided with a plurality of openings such as opening 18 which serve as lightening holes to reduce the weight of the overall holder. Also, the lobes 13 and 14 project towards one another in spaced opposition and are of an area substantially covering a major surface portion of the uppermost card of the stack of cards 12. This provides a frictional engagement with the underside of the lobes with the uppermost surface of the card to releasably retain the cards within the receptacle.

FIG. 1 further illustrates that the money clip includes a spring-loaded latch 20 which is adapted to releasably hold and restrain folded money represented by numeral 19 against the central plate 11. The upper end of the latch 20 includes a pair of spaced-apart legs 7 and 8 as shown in FIG. 5. A hinge 21 has its opposite ends secured to the legs and the length of the hinge is mounted in a cup 27 integrally formed with a flexible mount 22 outwardly projecting in a cantilevered manner from the top of plate 11 by an element 29. FIG. 4 reveals this relationship.

Referring now in detail to FIG. 2, it can be seen that the stack or plurality of the cards 12 reside within the receptacle between the opposing sides 15 and 16 and that a lower semicircular portion 23 extends beyond the lower or bottom edge of the sides 15 and 16. The semi-circular flange serves to support the stack while in the receptacle and permits exposure of the uppermost card for removal at the election of the user. Also, it can be seen that the flexible mount 22 provides a spring hinge or over-center toggle mechanism for the latch 20 whereby numeral 24 indicates the centerline over which the latch 20 may be positioned. For example, arrow 25 shows that the latch 20 may be on one side of the toggle line 24 to an open or non-biased position or may be positioned on the other side of the line to a closed or biased position. As illustrated in solid lines, the latch 20 is under the bias of the spring flexible mount 22 so that it is forcibly urged against the one side of plate 11. When money is folded and disposed between the inside of the latch and plate 11, the bias of the spring forcibly urges the latch 20 against the folded money for retention on the holder. However, when the latch 20 is positioned on the opposite side of line 24, the spring bias is reduced or eliminated so that the latch is loose and floppy. Once the latch 20 has been moved to the other side of the center toggle line 24, the spring bias takes over and urges the latch toward the plate 11 to capture any folded money in-between.

Referring to FIG. 3, it can be seen that the card limit stops 17 and 19 are formed from the upper end of sides 15 and 16 and the limit stops are integrally formed with the sides to define tabs 17 and 19. Also, the lobes 13 and 14 terminate in fixed, spaced-apart relationship and in opposition to one another wherein the space defined between the opposing lobes is indicated by numeral 26.

Referring now in detail to FIG. 4, the positions of the latch 20 are shown between the solid line position as being the closed position for retaining folded bills against plate 11, while in broken lines the latch has been rotated to its open or relaxed position to release the folded bills for removal from the holder. The biasing spring section or mount 22 shown in solid lines presses a cam 25 on the latch against the plate 11. The latch including hinge 21 pivots in a mount cup 27 and as the cam bears against the central plate 11 to the broken line position, the mount 22 flexes inward to its broken line position. The cam travel continues until the cam leaves the plate 11 then the mount is relaxed and the latch is floppy. Once the latch is returned to its closed position, the flex mount 22 is as indicated in the solid line position. A feature resides in providing the inside surface of the latch 20 along its entire length with a curved surface 28 so as to provide sufficient space for accommodating and holding the folded over portion of a stack of foldable money bills.

In view of the foregoing, it can be seen that the combined money clip and card holder of the present invention provides a light-weight device for not only holding a plurality of folded over bills but will also retain a stack of cards 12. The cards may be of the credit card type which include a rather smooth and slippery surface so it is important that the retaining area of the lobes 13 and 14.be of sufficient surface area in order to contact a substantial surface portion of the uppermost card in the stack. The over-center toggle mechanism or spring bias including the flex mount 22 provides a movement for latch 20 in combination with cam 25 which resists fatigue and is positive in its holding or retaining action against the stack of folded bills or when in its release position on the other side of the center toggle line, the latch is loose and without load.

FIG. 7 is another version of the present invention similar to the version shown in FIGS. 5 and 6. It is noted that an opening for receiving insertion and withdrawal of cards is provided adjacent the top edge of plate 11. The opening is defined between the. opposing spaced apart sides 15 and 16. The bottom of the plate 11 is partially closed by stop tabs 30 and 31 on which a stack of cards can rest when inserted through the top opening and slid beneath lobes 13 and 14. The respective tabs are an extension of sides 15 and 16 and are bent inwardly towards each other into the card storage compartment or cavity as shown in broken lines by numeral 32. The tabs do not form a part of the plate 11 and reside adjacent to a bottom edge 33.

Therefore, cards are introduced into the storage capability through the top opening and are stopped by tabs 30 and 31 at the bottom or lower end of the storage cavity. Since the combined money clip and card holder will be used with the top end up, the top opening is more convenient to use and the cards will be more readily retained in the storage cavity with the stop tabs supporting the stack of cards at the bottom or lower end.

FIG. 8, 9, and 10 disclose another version of the present invention which is shown in the general direction of arrow 40 and is similar to the embodiments shown in FIGS. 1–7 inclusive. The plate 11 retains the rounded or semi-circular edge portion 23 and the lobes 13 and 14 that define a storage cavity in cooperation with the opposing surface of plate 11. Card stops 41 and 42 are similar to stops 30 and 31 except for being curved to follow the semi-circular edge of portion 23. Also, as shown in FIGS. 9 and 10, the free or terminating ends of the tabs or stops 41 and 42 are rounded and void of sharp corners or edges.

FIGS. 8 and 9 illustrate a card releasable retaining means including at least one spring biasing member 43 carried on the side 16. If desired, a second member 44 may be carried on the inside of side 15. The member may be a leaf spring with one end secured to the side while its opposite end is free to slide against the side as it expands when cards are introduced to the storage cavity. The edge of the card or cards slidably bears against the raised center of the leaf spring which causes a retention pressure against the card or cards. The tops or tabs 41 and 42 prevent the card or cards from leaving the storage cavity from the bottom.

Figure 12:
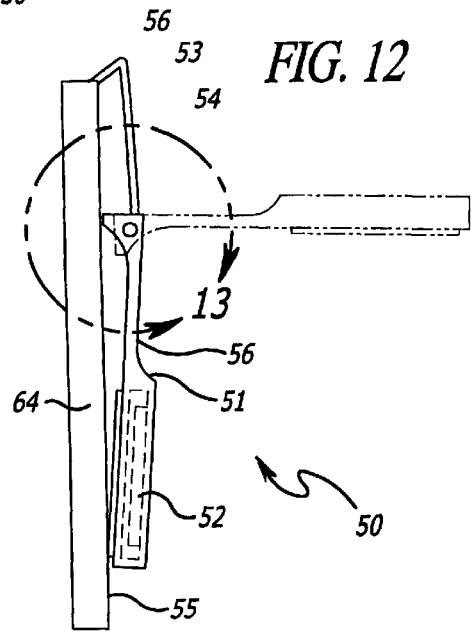
FIG. 12 is a side elevational view of the money clip and card holder shown in FIG. 11.
Figure 13:
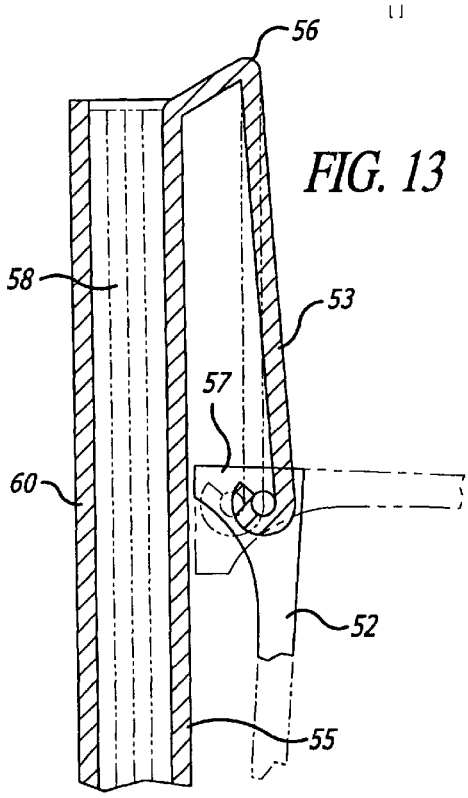
FIG. 13 is an enlarged sectional view of the money clip and card holder as taken in the direction of arrow 13 in FIG. 12.
Figure 14:
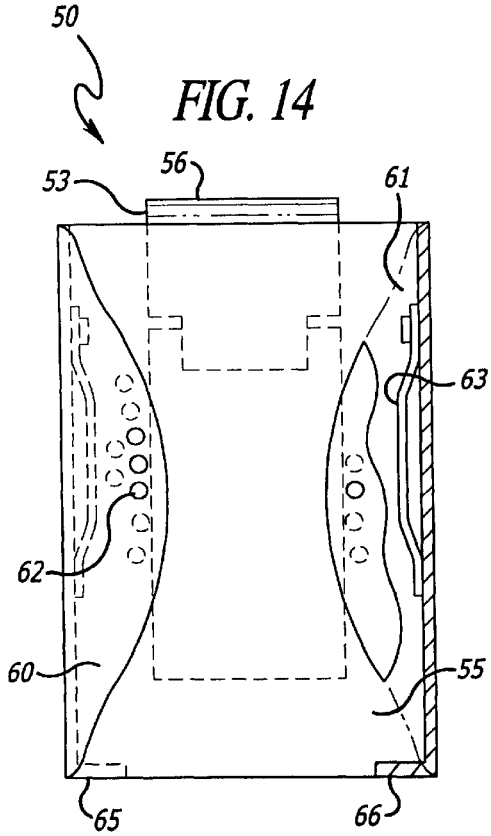
FIG. 14 is a rear elevational view thereof.

Referring to FIGS. 12–14 inclusive, another embodiment of the present invention is illustrated in the general direction of arrow 50, which includes a member 51 having a time piece, such as a watch or the like, carried thereon, as indicated by numeral 52. The member 51 is hingeably connected to a mount 53 by means of a spring-hinge 54. The mechanism for permitting member 51 to pivot, as shown in FIGS. 12 and 13, is identical to that which was previously described with respect to earlier embodiments. It is to be understood that the hinge 54 includes a spring biasing means which normally biases the member 51 so as to have an end which bears against the plate 55. The watch 52 is carried in a cavity or recess in the member 51 so that the dial face or crystal of the watch is flush with the exposed surface of the member 51. As illustrated in FIG. 12, the thickness of the member 51 is such that it will easily accommodate the thickness of the watch and that the member narrows, such as at end 56, which is connected to the hinge 54.

It can be seen in FIGS. 12 and 13 that the mount 53 is flexible about a flex-point or pivot point 56 and the mount 53 is illustrated in solid lines when a latch member 57 is against the plate 55. However, once the member 52 has been outwardly pivoted to its position shown in broken lines, the latch 57 is opened to permit the mount 53 to move into its broken line position. Therefore, the movement of member 52 between the solid and broken lines positions causes flexing of the mount 53 and it is this flexing which provides a biasing pressure against folded money which is between the member 52 and the plate 55. Release is achieved by moving the member 52 so as to open the latch which takes pressures off of any folded money that has been held in place against the plate 55. FIG. 13 also illustrates that the card storage is in a cavity 58 defined between the lobes 60 and 61, as previously described with respect to earlier embodiments.

FIG. 14 illustrates that the lobes, such as lobe 60, for holding the cards against plate 55 are provided with lightening apertures, such as indicated by numeral 62. Also, the cards held within the cavity between the plate 55 and the underside of the lobes is retained in position by means of stops 65 and 66 at the bottom of the storage compartment in spaced-apart relationship with respect to the mount 53. The cards are releasably held in the compartment by spring clips, such as clip 63, which is of a leaf-spring type. Therefore, it can be seen that the movable member 51, when combined with the watch 52, not only serves as a support for the watch but serves to releasably hold folded money in the space between the underside of the member 51 and the front side of plate 55. In order to firmly hold folded money in position, an anti-friction pad, as indicated by numeral 64 in FIG. 12, is employed. A plurality of business cards can be held on the opposite side of plate 55 and it is important to note that the cards are retained therein not only by the spring clips 63 but by the stops 65 and 66 at the bottom of plate 55. It is also important to note that these stops are at the bottom of the card storage compartment rather than at the top. The top would be adjacent the mount 53.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A one unitary construction holder for securely and simultaneously retaining both flexible, foldable paper currency and stiffened cards, said one-piece unitary construction comprising:

an elongated flat plate having a top end And a bottom end and with a pair of opposite sides defining a front planar surface and a rear planar surface therebetween;

a flexible mount downwardly depending from said flat plate and normal thereto and integrally carried at said top end of said flat plate and cantilevered outwardly from said front planar surface;

a member hingeably carried on said mount and adapted to more into and away from said front planner surface;

said flexible mount constituting a spring bias normally urging said member into a bearing relationship with said front planar surface;

latch means disposed on said member selectively engageable with said plate to release said spring biasing to remove said bearing relationship in response to pivotal movement of said member about said hinge away from said plate;

a pair of lobes attached to said opposite sides defining a card storage area in cooperation with said rear planar surface;

a recess provided in said member;

a time-piece secured in said recess having a crystal surface wherein an exposed external surface of said crystal is flush with and coextensive with an exterior surface of said member;

said flexible mount and said latch means provides an over-the-center toggle mechanism;

said latch means includes a pair of stab enlargements on said member adjacent to said hinge and operable to engage said front planar surface to flex said flexible mount in response to rotational movement of said member;

a card releasable retaining means disposed on said pair of opposite sides for releasably retaining cards under said lobes including at least one leaf spring member being a first end secured to a selected one of said pair of sides and a second end free to slidably engage against said selected side; and said leaf spring having a rounded center midway between said first end and said second end; a said leaf spring second end is adapted to slide against said selected side when cards are introduced under said lobes.

2. The holder defined in claim 1 wherein:

said member is a time piece portion carrying said time piece and an extension portion joining said time piece portion with said flexible mount.

* * * * *